US008537104B2

(12) United States Patent
Markvoort et al.

(10) Patent No.: US 8,537,104 B2
(45) Date of Patent: Sep. 17, 2013

(54) VARIABLE COMMON ELECTRODE

(75) Inventors: Wieger Markvoort, Enter (NL); Hjalmar Edzer Ayco Huitema, Veldhoven (NL); Bart Peeters, Lommel (BE)

(73) Assignee: Creator Technology B.V., Breda (NL)

( * ) Notice: Subject to any disclaimer, the term of this patent is extended or adjusted under 35 U.S.C. 154(b) by 719 days.

(21) Appl. No.: 12/513,335

(22) PCT Filed: Nov. 2, 2007

(86) PCT No.: PCT/NL2007/050528

§ 371 (c)(1), (2), (4) Date: Jul. 15, 2010

(87) PCT Pub. No.: WO2008/054210

PCT Pub. Date: May 8, 2008

(65) Prior Publication Data

US 2010/0289838 A1 Nov. 18, 2010

Related U.S. Application Data

(60) Provisional application No. 60/864,192, filed on Nov. 3, 2006, provisional application No. 60/865,015, filed on Nov. 9, 2006.

(51) Int. Cl.
*G09G 3/34* (2006.01)

(52) U.S. Cl.
USPC ..... 345/107; 359/296

(58) Field of Classification Search
USPC ..... 345/87, 107, 204, 691; 359/296
See application file for complete search history.

(56) References Cited

U.S. PATENT DOCUMENTS

| | | | | |
|---|---|---|---|---|
| 6,900,796 | B2 * | 5/2005 | Yasunishi et al. | 345/204 |
| 7,167,156 | B1 * | 1/2007 | Glass | 345/107 |
| 7,619,693 | B2 * | 11/2009 | Fujioka et al. | 349/38 |
| 2006/0209011 | A1 | 9/2006 | Miyasaka | |

FOREIGN PATENT DOCUMENTS

| | | | |
|---|---|---|---|
| CN | 1834763 | A | 9/2006 |
| JP | 2006-259532 | | 9/2006 |
| WO | WO 2005/055187 | A1 | 6/2005 |
| WO | WO 2006/030384 | A2 | 3/2006 |

OTHER PUBLICATIONS

International Search Report dated May 27, 2008 for PCT/NL2007/050528.

Taiwan Patent Office, Office Action, Patent Application Serial No. 096141642, Jul. 18, 2013, Taiwan.

* cited by examiner

*Primary Examiner* — Abbas Abdulselam

(57) ABSTRACT

A display device (100) includes a row driver (520) configured to provide a row voltage, and a row electrode (320) connected to the row driver (520). A column driver (530) is configured to provide N column voltage levels to a column electrode (330). Further, a common electrode driver (570) is configured to provide M common voltage levels to a common electrode (170). A pixel ($C_{DE}$) is connected between the column electrode (330) and the common electrode (170); and a controller (515) is configured to control timing of application of the N column voltage levels relative the M common voltage levels to provide NM effective pixel voltage levels across the pixel ($C_{DE}$).

23 Claims, 5 Drawing Sheets

VARIABLE COMMON ELECTRODE

FIELD OF THE INVENTION

The present invention relates to display devices, such as display devices provided with variable common electrode voltages.

BACKGROUND

Displays, such as liquid crystal (LC) and electrophoretic displays include particles suspended in a medium sandwiched between a drive or pixel electrode and a common electrode. The pixel electrode includes pixel drivers, such as an array of thin film transistors (TFTs) that are controlled to switch on and off to form an image on the display. The voltage difference ($V_{DE}=N_{Eink}=V_{CE}-V_{px}$ as shown in FIGS. 3 and 5A) between a TFT(s) or the pixel electrode(s) and the common electrode, which is on the viewer's side of the display, causes migration of the suspended particles, thus forming the image. Displays with an array of individually controlled TFTs or pixels are referred to as active-matrix displays.

In order to change image content on an electrophoretic display, such as from E ink Corporation for example, new image information is written for a certain amount of time, such as 500 ms to 1000 ms. As the refresh rate of the active-matrix is usually higher, this results in addressing the same image content during a number of frames, such as at a frame rate of 50 Hz, 25 to 50 frames. Circuitry to drive displays, such as active or passive displays, as well as electrophoretic displays, are well known, such as described in U.S. Pat. No. 5,617,111 to Saitoh; International Publication No. WO 2005/034075 to Johnson, International Publication No. WO 2005/055187 to Shikina; U.S. Pat. No. 6,906,851 to Yuasa; U.S. Patent Application Publication No. 2005/0179852 to Kawai; U.S. Patent Application Publication No. 2005/0231461 to Raap; U.S. Pat. No. 4,814,760 to Johnston; International Publication No. WO 01/02899 to Albert; and Japanese Patent Application Publication Number 2004-094168, each of which is incorporated herein by reference in its entirety.

FIG. 1 shows a schematic representation 100 of the E-ink principle, where different color particles, such as black micro-particles 110 and white micro-particles 120 suspended in a medium 130, are encapsulated by the wall of an E-ink capsule 140. Typically, the E-ink capsule 140 has a diameter of approximately 200 microns. A voltage source 150 is connected across a pixel electrode 160 and a common electrode 170 located on the side of the display viewed by a viewer 180. The voltage on the pixel electrode 160 is referred to as the pixel voltage $V_{px}$, while the voltage on the common electrode 170 is referred to as the common electrode voltage $V_{CE}$. The voltage across the pixel or capsule 140, i.e., the difference between the common electrode and pixel voltages, is shown in FIG. 5A as $V_{Eink}$.

Addressing of the E-ink 140 from black to white, for example, requires a pixel represented as a display effect or pixel capacitor $C_{DE}$ in FIGS. 3 and 5A and connected between pixel electrodes 160 and a common electrode 170, to be charged to −15V during 500 ms to 1000 ms. That is, the pixel voltage $V_{px}$ at the pixel electrode 160 (also shown in FIG. 5A as the voltage at node P) is charged to −15V, and $V_{Eink}=V_{CE}-V_{px}=0-(-15)=+15V$. During this time, the white particles 120 drift towards the top common electrode 170, while the black particles 110 drift towards the bottom (active-matrix, e.g., TFT, back plane) pixel electrode 160, also referred to as the pixel pad.

Switching to a black screen, where the black particles 110 move towards the common electrode 170, requires a positive pixel voltage $V_{px}$ at the pixel electrode 160 with respect to the common electrode voltage $V_{CE}$. In the case where $V_{CE}=0V$ and $V_{px}=+15V$, the voltage across the pixel ($C_{DE}$ in FIG. 5A) is $V_{Eink}=V_{CE}-V_{px}=0-(+15)=-15V$. When the voltage across the pixel $V_{Eink}$ is 0V, such as when both the pixel voltage $V_{px}$ at the pixel electrode 160 and the common electrode voltage $V_{CE}$ are 0V ($V_{px}=V_{CE}=0$), then the E-ink particles 110, 120 do not switch or move.

As shown in the graph 200 of FIG. 2, the switching time of the E-ink 140 (or $C_{DE}$ in FIGS. 3 and 5A) to switch between the black and white states decreases (i.e., the switching speed increases or is faster) with increasing voltage across the pixel $V_{DE}$ or $V_{Eink}$. The graph 200, which shows the voltage across the pixel $V_{Eink}$ on the y-axis in volts versus time in seconds, applies similarly to both switching from 95% black to 95% white screen state, and vice verse. It should be noted that the switching time decreases by more than a factor two when the drive voltage is doubled. The switching speed therefore increases super-linear with the applied drive voltage.

FIG. 3 shows the equivalent circuit 300 for driving a pixel (e.g., capsule 140 in FIG. 1) in an active-matrix display that includes a matrix or array 400 of cells that include one transistor 310 per cell or pixel (e.g., pixel capacitor $C_{DE}$) as shown in FIG. 4. A row of pixels is selected by applying the appropriate select voltage to the select line or row electrode 320 connecting the TFT gates for that row of pixels. When a row of pixels is selected, a desired voltage may be applied to each pixel via its data line or the column electrode 330. When a pixel is selected, it is desired to apply a given voltage to that pixel alone and not to any non-selected pixels. The non-selected pixels should be sufficiently isolated from the voltages circulating through the array for the selected pixels. External controller(s) and drive circuitry is also connected to the cell matrix 400. The external circuits may be connected to the cell matrix 400 by flex-printed circuit board connections, elastomeric interconnects, tape-automated bonding, chip-on-glass, chip-on-plastic and other suitable technologies. Of course, the controllers and drive circuitry may also be integrated with the active matrix itself.

In FIG. 4, the common electrodes 170 are connected to ground instead of a voltage source that provide $V_{CE}$. The transistors 310 may be TFTs, for example, which may be MOSFET transistors 310, as shown in FIG. 3, and are controlled to turn ON/OFF (i.e., switch between a conductive state, where current $I_d$ flows between the source S and drain D, and non-conductive state) by voltage levels applied to row electrodes 320 connected to their gates G, referred to as $V_{row}$ or $V_{gate}$. The sources S of the TFTs 310 are connected to column electrodes 330 where data or image voltage levels, also referred to as the column voltage $V_{col}$ are applied.

As shown in FIG. 3, various capacitors are connected to the drain of the TFT 310, namely, the display effect capacitor $C_{DE}$ that contains the display effect also referred to as the pixel capacitor, and a gate-drain parasitic capacitor $C_{gd}$ between the TFT gate G and drain D shown in dashed lines in FIG. 3. In order to hold the charge or maintain the level of pixel voltage $V_{px}$ (at node P to remain close to the level of the column voltage $V_{col}$) between two select or TFT-ON states (as shown by reference numeral 616 in FIG. 6A), a storage capacitor $C_{st}$ may be provided between the TFT drain D and a storage capacitor line 340. Instead of the separate storage capacitor line 340, it is also possible to use the next or the previous row electrode as the storage capacitor line.

SUMMARY OF THE INVENTION

It is desirable to have displays with high grey level accuracy and grey level distribution. This requires addressing the column electrode 330, shown in FIG. 3, with more column voltage $V_{col}$ levels. However, column driver integrated chips (ICs) with more voltage levels, or additional column driver ICs, are expensive. Further, the cost of the ICs increases more than linear with the number of voltage levels it can supply. Accordingly, there is a need for an efficient and cost effective display with high grey level accuracy and grey level distribution.

One object of the present devices and methods is to overcome the disadvantage of conventional displays.

This and other objects are achieved by display devices and methods comprising a row driver configured to provide a row voltage, and a row electrode connected to the row driver. A column driver is configured to provide N column voltage levels to a column electrode. Further, a common electrode driver is configured to provide M common voltage levels to a common electrode. A pixel is connected between the column electrode and the common electrode; and a controller is configured to control timing of application of the N column voltage levels relative the M common voltage levels to provide NM effective pixel voltage levels across the pixel.

Further areas of applicability of the present systems and methods will become apparent from the detailed description provided hereinafter. It should be understood that the detailed description and specific examples, while indicating exemplary embodiments of the displays and methods, are intended for purposes of illustration only and are not intended to limit the scope of the invention.

BRIEF DESCRIPTION OF THE DRAWINGS

These and other features, aspects, and advantages of the apparatus, systems and methods of the present invention will become better understood from the following description, appended claims, and accompanying drawing where:

DETAILED DESCRIPTION OF THE DRAWINGS

The following description of certain exemplary embodiments is merely exemplary in nature and is in no way intended to limit the invention, its application, or uses. In the following detailed description of embodiments of the present systems, devices and methods, reference is made to the accompanying drawings which form a part hereof, and in which are shown by way of illustration specific embodiments in which the described devices and methods may be practiced. These embodiments are described in sufficient detail to enable those skilled in the art to practice the presently disclosed systems and methods, and it is to be understood that other embodiments may be utilized and that structural and logical changes may be made without departing from the spirit and scope of the present system.

The following detailed description is therefore not to be taken in a limiting sense, and the scope of the present system is defined only by the appended claims. The leading digit(s) of the reference numbers in the figures herein typically correspond to the figure number, with the exception that identical components which appear in multiple figures are identified by the same reference numbers. Moreover, for the purpose of clarity, detailed descriptions of well-known devices, circuits, and methods are omitted so as not to obscure the description of the present system.

Figure 3:
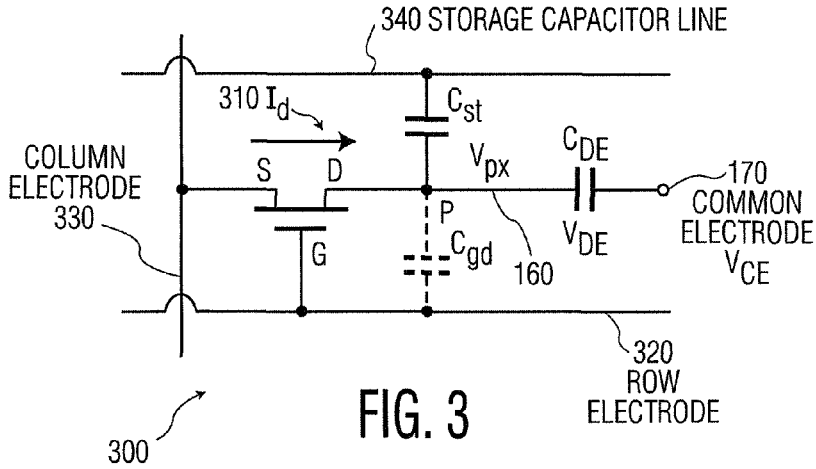
FIG. 3 shows the equivalent circuit of a pixel in a conventional active-matrix display.
Figure 5A:
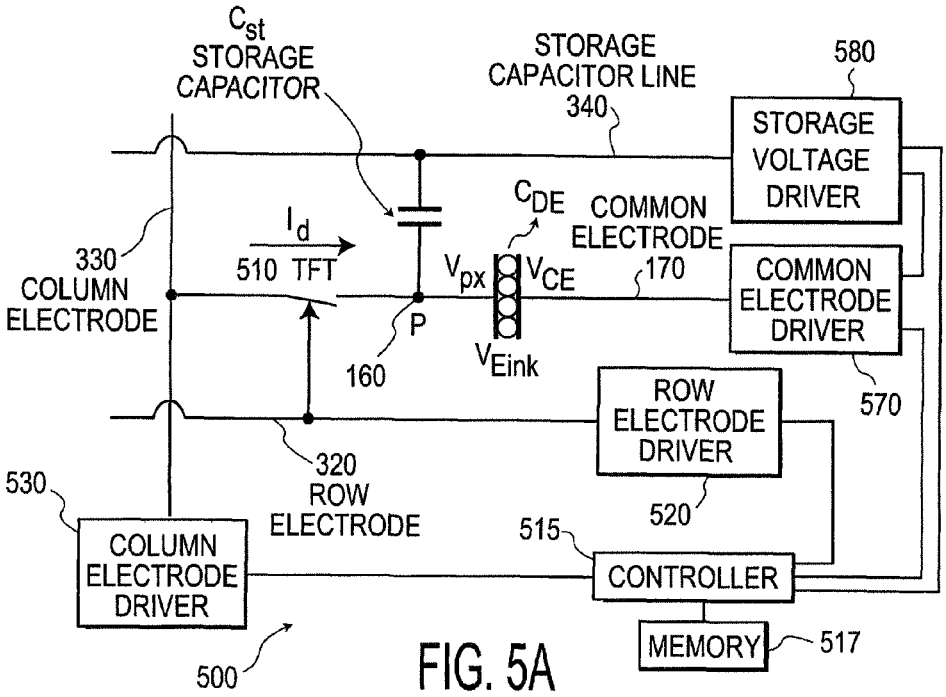
FIG. 5A shows a simplified circuit for the active matrix pixel circuit shown in FIG. 3.

FIG. 5A shows a simplified circuit 500 similar to the active matrix pixel circuit 300 shown in FIG. 3, where the TFT 310 is represented by a switch 510 controlled by a signal from the row electrode 320, and the pixel or E-ink is represented by a pixel capacitor $C_{DE}$ connected between one end of the TFT switch 510 and the common electrode 170. The other end of the TFT switch 510 is connected to the column electrode 330.

The TFT 310 or switch 510 closes or conducts when a voltage, e.g., negative voltage, form the row electrode is applied to the TFT gate G resulting in the flow of current $I_d$ through the TFT 310 (or switch 510) between its source S and drain D. As current $I_d$ flows through the TFT, the storage capacitor $C_{st}$ is charged or discharged until the potential of pixel node P at the TFT drain D equals the potential of the column electrode, which is connected to the TFT source S. If the row electrode potential is changed, e.g., to a positive voltage, then the TFT 310 or switch 510 will close or become non-conductive, and the charge or voltage at the pixel node P will be maintained and held by the storage capacitor $C_{st}$. That is, the potential at the pixel node P, referred to as the pixel voltage $V_{px}$ at the TFT drain D will be substantially constant at this moment as there is no current flowing through the TFT 310 or switch 510 in the open or non-conductive state.

The amount of charge on the storage capacitor $C_{st}$ provides or maintains a certain potential or voltage difference between the storage capacitor line 340 and pixel node P of the pixel capacitor $C_{DE}$. If the potential of the storage capacitor line 340 is increased by 5V, then the potential at the pixel node P will also increase by approximately 5V, assuming $\Delta V_{px} \approx \Delta V_{st}$ as will be described. This is because the amount of charge at both nodes of the storage capacitor $C_{st}$ is the same since the charges cannot go anywhere.

It should be understood that for simplicity, it is assumed that the change in the pixel voltage $\Delta V_{px}$ across the pixel $C_{DE}$ is approximately equal to the change in the storage capacitor voltage $\Delta V_{st}$ across the storage capacitor $C_{st}$, i.e., $\Delta V_{px} \approx \Delta V_{st}$. This approximation holds true particularly when $C_{st}$ is the dominant capacitor, which should be the case. A more exact relation between $V_{px}$ and $V_{st}$ is given by equation (1):

$$\Delta V_{px} = (\Delta V_{st})[(C_{st})/(C_{TOTAL})] \quad (1)$$

where $\Delta V_{px} \approx \Delta V_{st}$ when $C_{TOTAL} \approx C_{st}$ and thus $(C_{st})/(C_{TOTAL}) \approx 1$ The total pixel capacitance $C_{TOTAL}$ is defined as the sum of all capacitance, namely:

$$C_{TOTAL} = C_{st} + C_{DE} + C_{rest} \quad (2)$$

where $C_{rest}$ is the sum of all other capacitance (including parasitic capacitance) in the pixel.

Further it should be noted that, in addition to expressing the change in the pixel voltage $\Delta V_{px}$ (at node P in FIG. 5A) in terms of the change in the voltage $\Delta V_{st}$ (across the storage capacitor $C_{st}$) as shown in equation (1), $\Delta V_{px}$ may be expressed in terms of the change in the common voltage $\Delta V_{CE}$ as shown in equation (3):

$$\Delta V_{px} = (\Delta V_{st})[(C_{st})/C_{TOTAL})] = (\Delta V_{CE})[(C_{DE})/(C_{TOTAL})] \quad (3)$$

where $C_{DE}$ is capacitance of the display effect or pixel.

It is desired not to effect the voltage across the pixel $V_{Eink}$ and thus not to effect the displayed image when voltages are changed. Having no display effects or no pixel voltage change means that $\Delta V_{Eink}=0$.

Since $V_{Eink}=V_{CE}-V_{px}$ then:

$$\Delta V_{Eink}=\Delta V_{CE}-\Delta V_{px}=0 \quad (4)$$

Equation (4) indicates the desirable maintenance of the displayed image with substantially no changes in display effects when voltages are changed. That is, the change in the voltage across the pixel $\Delta V_{Eink}$ is desired to be zero so that black or white states are maintained without any substantial change, for example.

Substituting $\Delta V_{px}$ from equation (3) into equation (4) yields:

$$\Delta V_{CE}-(\Delta V_{st})[(C_{st}/C_{TOTAL})]=0 \quad (5)$$

It can be seen from equation (5) that the relation between $\Delta V_{CE}$ and $\Delta V_{st}$ may be given by equations (6) and (7)

$$\Delta V_{CE}=(\Delta V_{st})[(C_{st}/C_{TOTAL})] \quad (6)$$

$$\Delta V_{st}=(\Delta V_{CE})[(C_{TOTAL}/C_{st})] \quad (7)$$

Thus, when the common electrode voltage is changed by an amount $\Delta V_{CE}$, then it is desired to change the voltage on the storage line by $\Delta V_{st}$ that satisfies equation (7).

As seen from equation (6) or (7), in order to prevent any voltage change $\Delta V_{Eink}$ across the pixel $C_{DE}$ i.e., to ensure that $\Delta V_{Eink}=0$, and thus substantially maintain the same display effect with substantially no change of the displayed image, the common voltage $V_{CE}$ and the storage capacitor voltage $V_{st}$ are changed at substantially the same time and by substantially the proper amount with respect to each other as shown by equations (6) or (7). In particular, when $V_{st}$ and $V_{CE}$ are changed by amounts that satisfy equation (6) or (7) and at substantially the same time, then there will be no change in the voltage across the pixel $C_{DE}$, i.e., $\Delta V_{Eink}=0$.

The voltage across the pixel capacitor $C_{DE}$, i.e., the voltage difference between the common electrode 170 and the pixel node P (i.e., $V_{Eink}$) is responsible for switching of the display and forming an image along with the rest of the pixel matrix array. If the potential on the common electrode 170 and the storage capacitor line 340 are changed at substantially the same time (e.g., the two are connected together—possibly via a scaler—or are under the control of the same controller 515), and with amounts that substantially satisfy equation (6) or (7), then the potential at the pixel node P will change by substantially the same amount as the potential change of the common electrode voltage and at substantially the same time. Effectively, this means that voltage $V_{Eink}$ across the pixel capacitor $C_{DE}$ remains constant (i.e., $V_{Eink}=0$).

On the other hand, if the common electrode 170 and the storage capacitor line 340 are not connected together, then a voltage $V_{CE}$ change of the common electrode 170 will also have an effect or change the voltage $V_{Eink}$ across the pixel capacitor $C_{DE}$. That is, the change in the common electrode potential $V_{CE}$ will have an effect on the whole display. Further, if the common electrode potential $V_{CE}$ is changed while a row is selected (i.e., TFT 310 is closed or conducting), it may result in a different behavior for that selected row and may result in image artifacts.

It should be noted that the storage capacitor $C_{st}$ in an active-matrix circuit designed to drive the E-ink (or pixel/display effect capacitor $C_{DE}$) is 20 to 60 times as large as the display effect capacitor $C_{DE}$ and gate-drain capacitors $C_{gd}$. Typically, the value of the display effect capacitor $C_{DE}$ is small due to the large cell gap of the E-ink and the relatively large leakage current of the E-ink material. The leakage current is due to a resistor in parallel with the display effect capacitor $C_{DE}$. The small value of the display effect capacitor $C_{DE}$ coupled with the leakage current require a relatively large storage capacitor $C_{st}$.

The various electrodes may be connected to voltage supply source(s) and/or drivers which may be controlled by a controller 515 that controls the various voltage supply sources and/or drivers, shown as reference numerals 520, 530, 570, connected to the row electrode 320, the column electrode 330, and the common electrode 170, respectively. The controller 515 drives the various display electrodes or lines, e.g., pixel cell shown in the equivalent circuit 500, with pulses having different voltage levels as will be described.

To realize the proper amount and timing of changes of the voltages of the storage capacitor voltage $V_{st}$ and common voltage $V_{CE}$, namely changing both storage and common voltages $V_{st}$, $V_{CE}$ at substantially the same time and by substantially the proper amount, namely, $\Delta V_{st}=(\Delta V_{CE})[(C_{TOTAL}/C_{st})]$, as shown in equation (7), the common electrode driver 570 may be connected to the storage capacitor line 340 through a storage driver 580 which may be programmable or controllable by the controller 515. In this case the storage driver 580 is a scaler which generates an output signal $V_{st}$ that corresponds to the common voltage $V_{CE}$. In other words, the voltage $V_{st}$ of the output signal varies proportionally, preferably linearly proportionally with the common voltage $V_{CE}$. Alternatively the storage driver 580 may be a driver separate from controller 515. In this case the connection between the common electrode driver 570 and the storage driver 580 is superfluous. The controller 515 may be configured to change the storage and common voltages $V_{st}$, $V_{CE}$ at substantially the same time and control the storage driver 580 such that the storage and common voltage changes correspond, e.g. satisfy the relationship shown by in equation (6) or (7), for example.

Figure 5B:
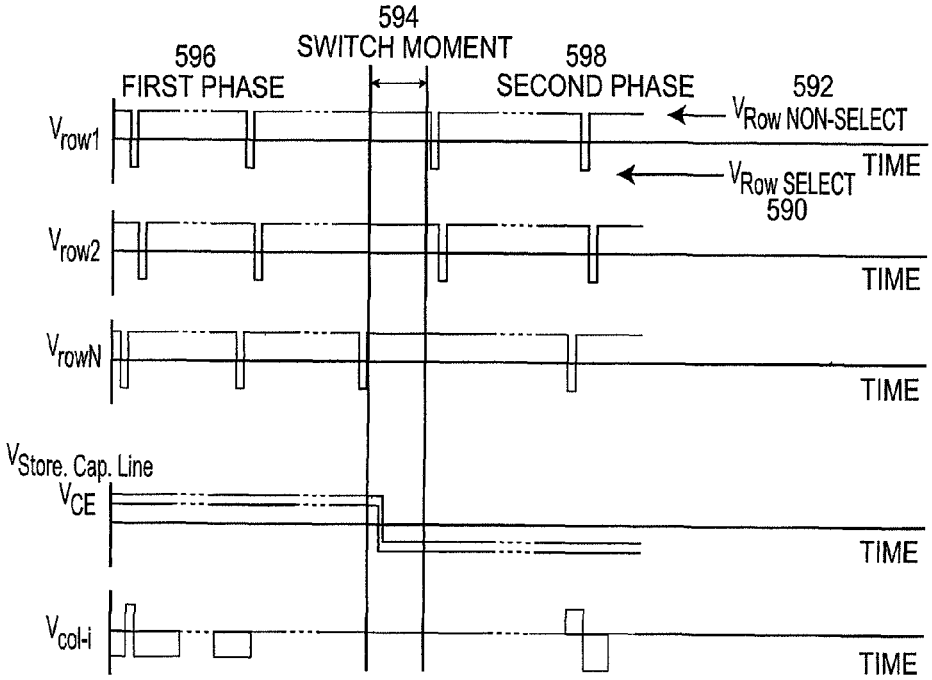
FIG. 5B shows a timing diagram for switching voltages according to one embodiment.

Artifacts may result in the displayed image if the storage and common voltages $V_{st}$, $V_{CE}$ are not switched at the substantially same time. Further, as shown in FIG. 5B, the storage and common voltages $V_{st}$, $V_{CE}$ are not only switched at substantially the same time, but also are switched when none of the rows are selected. Alternatively the Vce and Vst are switched at substantially the same time (1) when no rows are selected; or (2) at the start of any row selection time; or (3) during a row selection time after which the selected row gets at least a full row selection period to charge the pixels to the column voltage level. In particular, preferably the switch of the Vce and the Vst does not result in one or more pixels being charged to an incorrect voltage (i.e. another voltage than the column voltage). In particular, FIG. 5B shows row or gate voltages of rows 1, 2 and N, of any row in the active matrix, where a low level 590 $V_{row\text{-}select}$, for example, selects a row or turns ON the TFT 510 (conductive state, switch closed), and a high level 592

$V_{row\ non\text{-}select}$ turns OFF the TFT 510 (non-conductive state, switch open). The rows are sequentially selected one at a time by applying an appropriate voltage level on a row, where none of the rows are selected during switching time period 594 separating first and second phases 596, 598, respectively. Although not relevant from the timing point of view of the changes in the common voltages $V_{st}$, $V_{CE}$, the column voltage is also shown in FIG. 5B for illustrative purposes. It should be noted that the switching time period 590 may occur during any desired time where the sequential row addressing is interrupted, such as after all the rows are addressed, or half the rows are addressed or after any number of rows are addressed, as desired. After the switch period 590, the next row is addressed and the sequential row addressing is resumed.

The controller 515 may be any type of controller and/or processor which is configured to perform operation acts in accordance with the present systems, displays and methods, such as to control the various voltage supply sources and/or drivers 520, 530, 570, 580 to drive the display 500 with pulses having different voltage levels and timing as will be described. A memory 517 may be part of or operationally coupled to the controller/processor 515. It should be understood that the various drivers 520, 530, 570, 580 may be connected to one or more voltage sources or buses connected to the voltage source(s).

The memory 517 may be any suitable type of memory where data are stored, (e.g., RAM, ROM, removable memory, CD-ROM, hard drives, DVD, floppy disks or memory cards) or may be a transmission medium or accessible through a network (e.g., a network comprising fiber-optics, the world-wide web, cables, or a wireless channel using time-division multiple access, code-division multiple access, or other radio-frequency channel). Any medium known or developed that can store and/or transmit information suitable for use with a computer system may be used as the computer-readable medium and/or memory. The memory 517 or a further memory may also store application data as well as other desired data accessible by the controller/processor 515 for configuring it to perform operation acts in accordance with the present systems, displays and methods.

Additional memories may also be used. The computer-readable medium 517 and/or any other memories may be long-term, short-term, or a combination of long-term and short-term memories. These memories configure the processor 515 to implement the methods, operational acts, and functions disclosed herein. The memories may be distributed or local and the processor 515, where additional processors may be provided, may also be distributed or may be singular. The memories may be implemented as electrical, magnetic or optical memory, or any combination of these or other types of storage devices. Moreover, the term "memory" should be construed broadly enough to encompass any information able to be read from or written to an address in the addressable space accessed by a processor. With this definition, information on a network is still within the memory 517, for instance, because the processor 515 may retrieve the information from the network for operation in accordance with the present system.

The processor 515 is capable of providing control signals to control the voltage supply sources and/or drivers 520, 530, 570, 580 to drive the display 500, and/or performing operations in accordance with the various addressing drive schemes to be described. The processor 515 may be an application-specific or general-use integrated circuit(s). Further, the processor 515 may be a dedicated processor for performing in accordance with the present system or may be a general-purpose processor wherein only one of many functions operates for performing in accordance with the present system. The processor 515 may operate utilizing a program portion, multiple program segments, or may be a hardware device, such as a decoder, demodulator, or a renderer such as TV, DVD player/recorder, personal digital assistant (PDA), mobile phone, etc, utilizing a dedicated or multi-purpose integrated circuit(s).

Any type of processor may be used such as dedicated or shared one. The processor may include micro-processors, central processing units (CPUs), digital signal processors (DSPs), ASICs, or any other processor(s) or controller(s) such as digital optical devices, or analog electrical circuits that perform the same functions, and employ electronic techniques and architecture. The processor is typically under software control for example, and has or communicates with memory that stores the software and other data.

Clearly the controller/processor 515, the memory 517, and the display 500 may all or partly be a portion of single (fully or partially) integrated unit such as any device having a display, such as flexible, rollable, and wrapable display devices, telephones, electrophoretic displays, other devices with displays including a PDA, a television, computer system, or other electronic devices. Further, instead of being integrated in a single device, the processor may be distributed between one electronic device or housing and an attachable display device having a matrix of pixel cells 500.

Figure 6A:
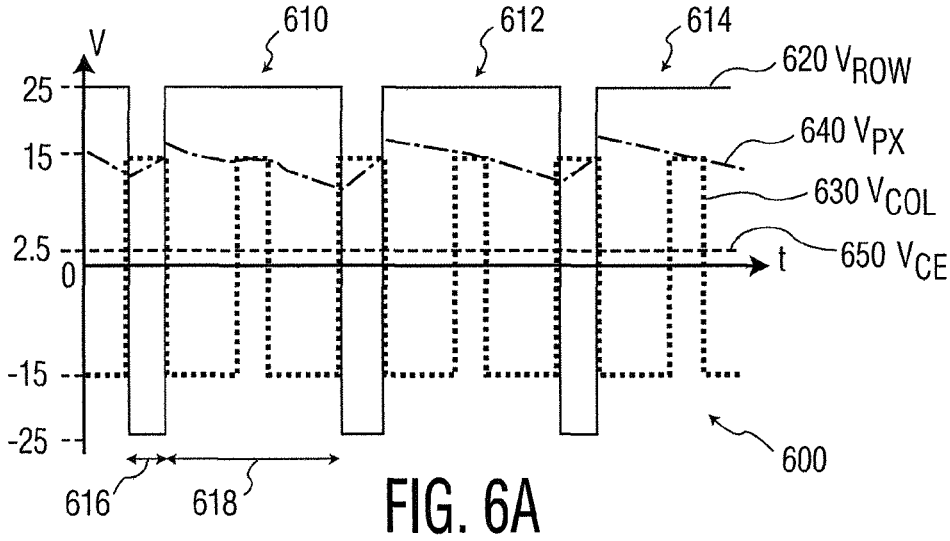
FIGS. 6A-6C show various voltage pulses during three frames using an active-matrix drive scheme for addressing E-ink.
Figure 6B:
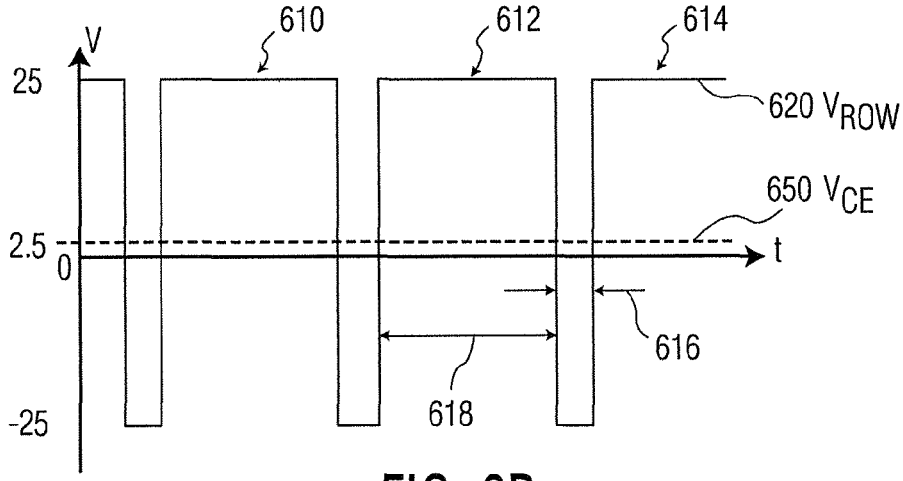
Figure 6C:
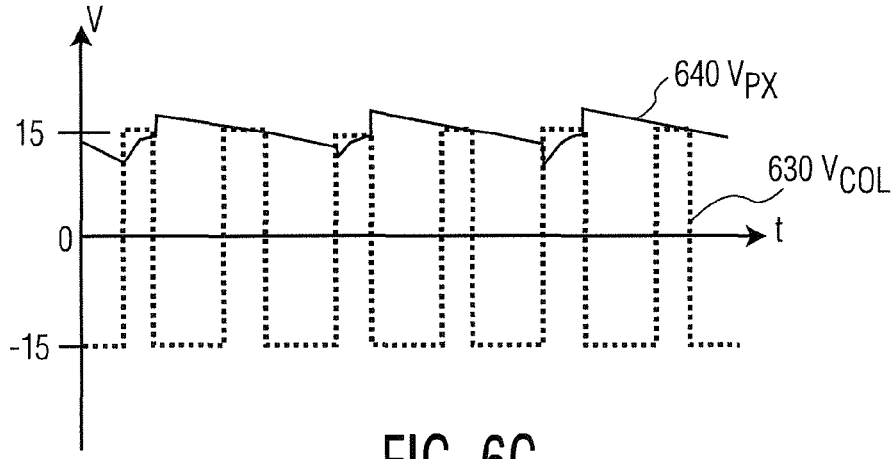

Active-matrix displays are driven one row-at-a-time. During one frame time, all the rows are sequentially selected by applying a voltage that turns on the TFTs, i.e., changes the TFTs from the non-conducting to the conducting state. FIGS. 6A-6C show voltage levels versus time at various nodes of the equivalent circuit (300 of FIG. 3 or 500 of FIG. 5A).

In particular, FIG. 6A shows a graph 600 of three frames 610, 612, 614 using the active-matrix drive scheme for addressing E-ink showing four superimposed voltage pulses. A solid curve 620 represents the row voltage $V_{row}$ present at the row electrode 320 of FIGS. 3 and 5A, also shown in FIG. 6B which only shows two of the four voltage pulses, where the other two voltage pulses are shown in FIG. 6C for clarity. In FIG. 6A, the dashed line 650 is the voltage $V_{CE}$ present at the common electrode 170 shown in FIGS. 1, 3 and 5A, also shown in FIG. 6B. In FIG. 6A, the dotted curve 630 represents the column voltage $V_{col}$ present at the column electrode 330 shown in FIGS. 3 and 5A, also shown in FIG. 6C as a dotted line 630. A semi-dashed curve 640 in FIG. 6A represents the pixel voltage $V_{px}$ present at the pixel node P at one terminal of the pixel capacitor $C_{DE}$ of FIG. 5A, also shown in FIG. 6C as a dotted line 640 for clarity.

The graph 600 of FIG. 6A shows the pulses as applied in a polymer electronics active-matrix back plane with p-type TFTs. For n-type TFTs (e.g. amorphous silicon), the polarity of the row pulses and the common electrode voltage change. In this graph 600 shown in FIG. 6A, only 6 rows are addressed as shown by the 6 dotted pulses 630, however it is understood that an actual display contains much more rows.

During a hold or non-select period 618 of a frame 610 shown in FIG. 6A, the row voltage $V_{row}$ solid line 620 is high, e.g., 25V, thus turning OFF the TFT 310 (non-conducting state, i.e., switch 510 is open). During a select portion 616 of the frame 610 where the TFT 310 is conducting (i.e., switch 510 is closed and the selected row is addressed), the pixel capacitors $C_{DE}$ shown in FIG. 5A (i.e. the total capacitance at the drain side of the TFT 310 or switch 510) of the selected row are charged to the voltage supplied on the column electrodes 330. During the remaining frame time 618 (i.e. the hold time), the current row is not addressed but the other rows are addressed sequentially, for example, as shown in FIG. 5B. During the hold period 618, the TFTs are in their non-conducting state and the charge on the pixel capacitors is retained, e.g., by the charges stored in the storage capacitor $C_{st}$ (FIGS. 3 and 5A), for example.

Figure 1:
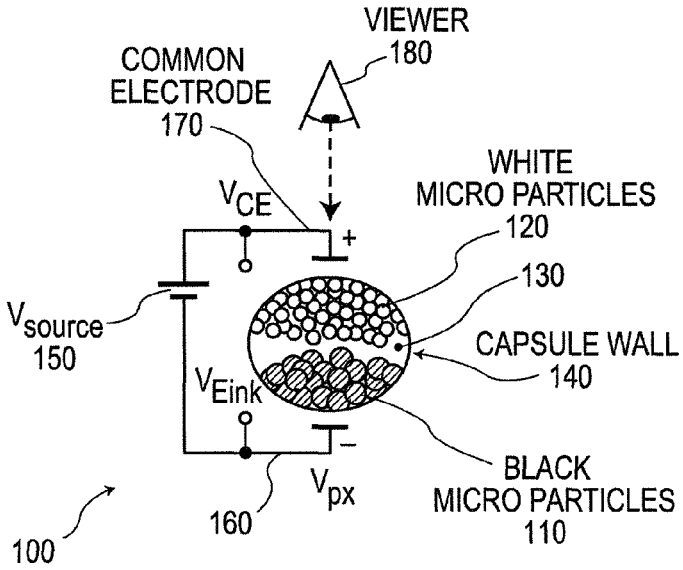
FIG. 1 shows a conventional E-ink display device.
Figure 2:
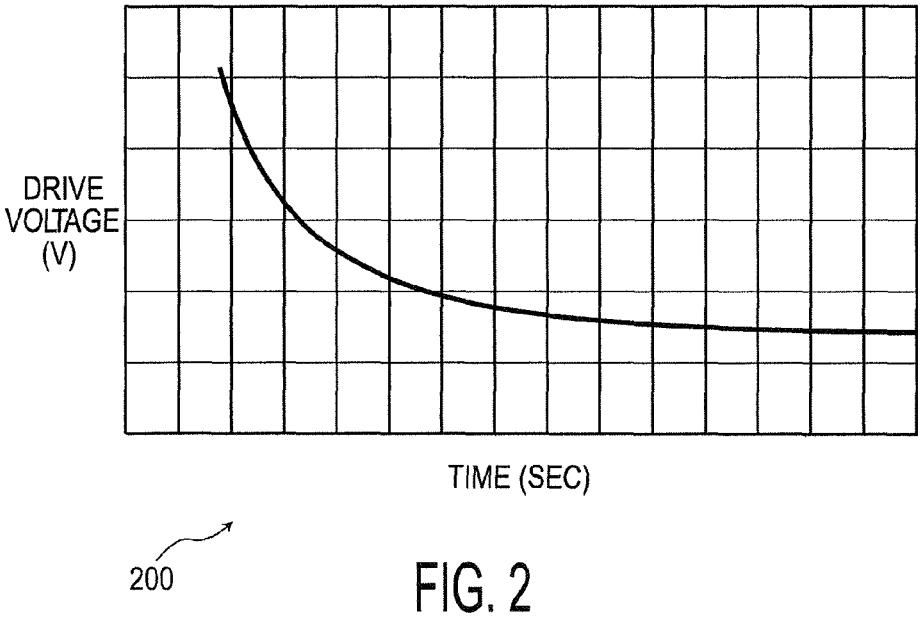
FIG. 2 shows the switching speed of E-ink as a function of the addressing voltage.

When a negative column voltage 630, e.g., −15V, is supplied to a pixel, this pixel switches towards the white state, and when a positive voltage is supplied on the column 530, e.g., +15V, then the pixel switches towards the black state, as shown in FIG. 1. During one frame, some pixels may be switched towards white, while others are switched towards black. For polymer electronics, active-matrix back planes of addressable TFTs or pixel electrodes with E-ink, the typical voltage levels are −25V for the row select voltage (during the select period 616), and a row non-select voltage of +25 V (during the non-select period 618), a column voltage between −15V (white pixel) and +15 V (black pixel), and a common electrode voltage of +2.5V, as shown in FIGS. 6A-6C.

Figure 7A:
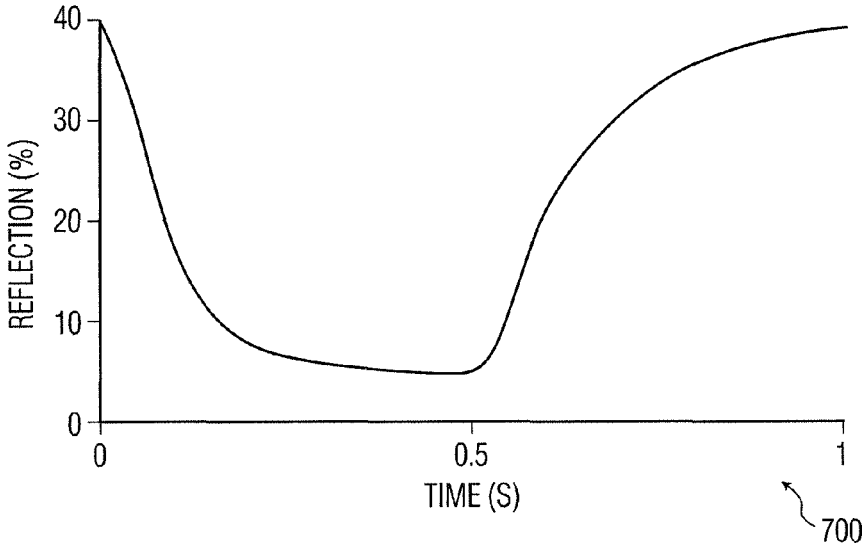
FIGS. 7A-7B show switching curve at effective display effect voltages $V_{Eink}$ of ±15V and ±7.5V, respectively.
Figure 7B:
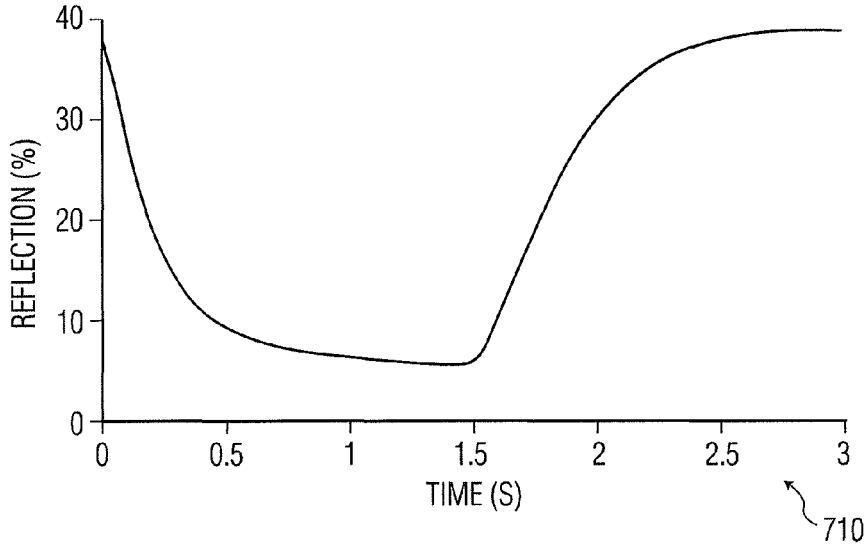

The typical display effect voltages (i.e. $V_{Eink}$ across the pixel capacitor $C_{DE}$ shown in FIG. 5A) are +15V, 0V and −15V. For such voltage levels, the optical switching characteristic 700 of percent reflection versus time is shown in FIG. 7A, where the switching time is approximately 0.5 seconds. If the voltages are reduced from 15V to 7.5V, then switching time is increased to approximately 1.5 seconds, as shown by the curve 710 of FIG. 7B. It should be noted that both curves 700, 710 shown in FIGS. 7A-7B have the same behavior or shape; the difference between the two curves 700, 710 is the transition speed, namely, approximately 0.5 seconds for the curve 700 associated with the higher voltage levels of ±15V, and approximately 1.5 seconds for the curve 710 associated with the lower voltage levels of ±7.5V.

To increase grey level accuracy and grey level distribution, additional effective pixel voltage levels $V_{Eink}$ across the pixel capacitor $C_{DE}$ are provided without the need for expensive column driver integrated ICs with more voltage levels, where existing voltage drivers and levels are used in various combinations to provide additional display effect voltage levels $V_{DE}$ or $V_{Eink}$, e.g., under the control of the controller 515 shown in FIG. 5A. In particular, the common voltage $V_{CE}$ is changed to provide different display effect voltages $V_{Eink}$ across the pixel $C_{DE}$.

Figure 4:
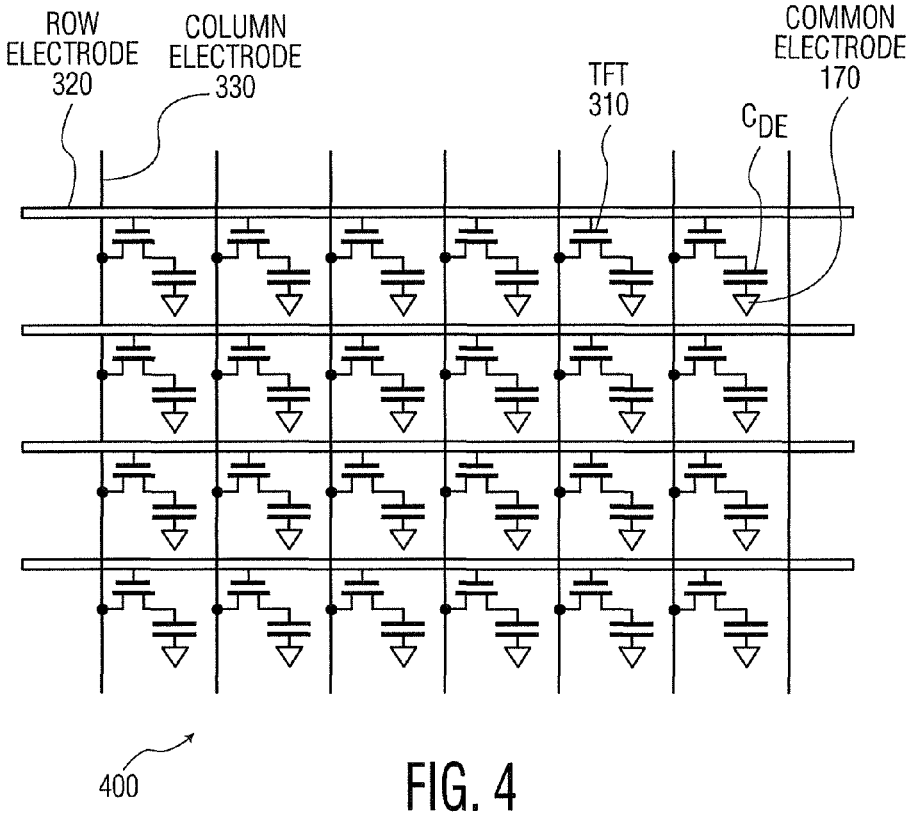
FIG. 4 shows an array of cells of an active-matrix display.

Normally, the common electrode 170 is grounded, as shown in FIG. 4, or has a voltage level that equals the kickback voltage $V_{KB}$ where $V_{px}=V_{col}+V_{KB}$. In the case where the $V_{CE}$ level is approximately 0V when the pixels are charged with +15V, 0V or −15V (i.e., $V_{col}$ or $V_{px}$), such as from the voltage source or driver 530 (FIG. 5A) that provides these voltage levels to the column electrode 330, then the effective pixel voltage levels $V_{Eink}$ across the pixel capacitor $C_{DE}$ is −15V, 0V or +15V (since $V_{CE}=0V$ and $V_{Eink}=V_{CE}-V_{col}$).

Kickback refers to the following phenomenon. During the conducting state of the TFT ($V_{row}=-25V$) the small gate-drain parasitic capacitor $C_{gd}$ and the capacitors $C_{st}$ and $C_{DE}$ will be charged (FIGS. 3 and 5A). At the moment that the TFT is switched off ($V_{row}$ will be switched to +25V) the voltage over capacitor $C_{gd}$ will increase by 50V (from −25V to +25V). Charges will move from $C_{gd}$ to $C_{st}$ and $C_{DE}$ resulting in an increase of $V_{px}$ just after the TFT is switched off. Because $C_{gd}$ is relatively small compared to the other capacitors, the increase of the potential of $V_{px}$ is also small.

In general, a small additional $\Delta V_{CE}$ is required on top of the mentioned $V_{CE}$ voltages (e.g., on top of 0V or other positive and/or negative values). The reason is that parasitic capacitances (e.g., $C_{gd}$) in the pixel cause a small voltage jump when the row changes from low to high voltage. This jump is called the kickback voltage $V_{KB}$ and can be calculated as follows: $\Delta V_{KB}=\Delta V_{row}\ (C_{gd}/C_{TOTAL})$. This must be added to $V_{CE}$ in order to have the right $V_{Eink}$. Thus, it should be understood that this small additional kickback voltage should be added to all the described $V_{CE}$ voltages, and/or the column voltages $V_{col}$ to yield a proper pixel voltage $V_{px}$.

Instead of using a constant voltage level, such as 0V, or using a positive voltage level and 0V for the common voltage $V_{CE}$ applied to the column electrode 330, variable voltage levels that include positive and negative voltage levels (as well as approximately 0V, or $0V+\Delta V_{KB}$, as needed) for the common voltage $V_{CE}$ are applied on the common electrode 170. The variable voltage levels for the common voltage $V_{CE}$ are used to create many different effective voltage levels $V_{Eink}$ across the pixel capacitor $C_{DE}$. The additional effective pixel voltages $V_{Eink}$ across the pixel capacitor $C_{DE}$ provides for more grey scale levels for example, and thus enhances the display effect. For example, additional effective pixel voltages $V_{Eink}$ may be provided by adding a 1-ouput common electrode driver 570 to the display 500, to provide positive and/or negative common electrode voltage $V_{CE}$. Alternatively, or in addition, the controller 515 may be configured to change the voltage level of the common electrode voltage $V_{CE}$ to provide the additional levels, e.g., by combining (e.g., scaling, adding and/or subtracting) voltage levels provided from existing voltage sources and/or drivers, such as scaling the ±15V level of the column voltage Vow and/or the voltage source that provides the ±15V level, and adding and/or subtracting the scaled ±10V level to the current common electrode voltage $V_{CE}$ of 0V, for example.

For example, if the common electrode voltage is increased by 10V, then the effective pixel voltage $V_{Eink}$ will be reduced with 10V. In the case where $V_{CE}=+10V$, (instead of −15V, 0V or +15V for $V_{Eink}$ (where $V_{Eink}=V_{CE}-V_{col}$ assuming $V_{col}=V_{px}$, i.e., ignoring the kickback voltage $V_{KB}$) when $V_{col}=+15V$, 0V or −15V and $V_{CE}=-0V$), the effective pixel voltage levels $V_{Eink}$ will be −5V, 10V and 25V respectively when the pixels are charged with +15V, 0V or −15V (i.e., when $V_{Col}\approx V_{px}=+15V$, 0V or −15V, while $V_{CE}=10V$). Similarly, when the common electrode voltage is decreased by 10V, i.e., $V_{CE}=-10V$ and $V_{col}\approx V_{px}=+15V$, 0V or −15V, then the effective pixel voltage levels $V_{Eink}$ will be approximately −25V, −10V and 5V, respectively.

As described above, to be more precise, the kickback voltage $V_{BK}$ should be included, where $V_{px}=V_{col}+V_{KB}$. Thus illustratively, a more precise value for the effective pixel voltage levels $V_{Eink}=V_{CE}-V_{px}=V_{CE}-(V_{col}+V_{KB})=V_{CE}-V_{col}-V_{KB})$ will be approximately $-25-V_{KB}$ V, $-10-V_{KB}$ V and $5-V_{KB}$ V, when $V_{col}=+15V$, 0V or −15V. The other illustrative examples may also be modified to include the kickback voltage $V_{BK}$ to provide more precise illustrations.

Thus, with 3 possible column voltages (e.g., +15V, 0V or −15V) and 2 different common electrode voltages (e.g., any combination of +10V, 0V or −10V; such as ±10, +10 and 0, −10 and 0), then 6 different effective pixel voltages $V_{Eink}$ may be created or achieved. More generally, N (e.g., N=6) different voltages may be achieved to provide N different display effects, where N is the number of column voltages (e.g., 3) multiplied by the number of common electrode voltages (e.g., 2).

It should be noted that only the number (e.g., 3) of column driver voltage levels may be generated during one point in time, because at any point in time, the common electrode voltage $V_{CE}$ can have only one value. Therefore, such a drive or addressing scheme is suitable for bi-stable display effects, like electrophoretic effects. For these display effects, at different points in time, a different common electrode voltage may be used, such as positive, negative and/or zero voltage levels, thus generating the full N different levels. A better grey scale distribution and accuracy may be realized because the effective pixel voltage levels $V_{Eink}$ across the pixel capacitor $C_{DE}$ include more values, e.g., 5V, −10V, −25V (when $V_{CE}=+10V$ and $V_{col}=+15V$, 0V, −15V) as well as +25V, +10V, −5V (when $V_{CE}=-10V$), in addition to +15V, 0V, −15V (when $V_{CE}=0V$).

In order to avoid image artifacts, the common electrode 170 may be switched when all rows are non-selected, e.g., when the row voltage $V_{row}$ applied to the gates G of the TFTs 310 in the TFT matrix is low, e.g., 0V, so that the TFTs 310 are in the non-conducting or OFF state. Alternatively the Vce and Vst are switched at substantially the same time: (1) when no rows are selected; or (2) at the start of any row selection time; or (3) during a row selection time after which the selected row gets at least a full row selection period to charge the pixels to the column voltage level. In particular, preferably the switch of the Vce and the Vst does not result in one or more pixels being charged to an incorrect voltage (i.e. another voltage than the column voltage). If a row is selected, e.g., by applying a low level for the row voltage $V_{row}$ applied to the gates G of the TFTs in the selected row as shown by reference numeral 616 in FIG. 6A, then the selected row will have a different behavior as all other rows. After the common electrode voltage $V_{CE}$ is changed, then the pixel voltage $V_{px}$ at node P, and consequently the effective pixel voltage $V_{Eink}$ across the pixel $C_{DE}$, will also change. This may also lead to image artifacts. To avoid such image artifacts, the pixel voltage $V_{px}$ on the pixel pads is changed at the same time as the common electrode voltage $V_{CE}$. In the configuration shown in FIG. 6 where a separate storage capacitor line 340 is provided, image artifacts are avoided by changing the voltage on the storage capacitor line 340 at the same time and with the same voltage swing as the common electrode 170. As the storage capacitor is typically larger, e.g., 20 times larger, than all other capacitors in the pixel, the voltage over the pixel $C_{DE}$ will keep the same value when both the storage capacitor line 340 and the common electrode 170 are switched at the same time.

In principle it is possible to choose the common electrode and column voltages $V_{CE}$ $V_{col}$ independently. However, most choices of common electrode voltage $V_{CE}$ will result in loss of a zero voltage state over the pixels. The zero voltage state is important as the electrophoretic display effect will not switch at 0V. Thus, to ensure and achieve a 0V state as one of the levels for the effective pixel voltage $V_{Eink}$, the column voltage $V_{col}$ may be added and/or subtracted to or from the normal common electrode voltage $V_{CE}$ to create the 0V state for the effective pixel voltage $V_{Eink}$. For example, if the column voltage levels are +10V, 0V and −10V, then practically best used common voltages are then:

$$V_{CE\text{-}high}=V_{CE\text{-}normal}+10\text{V and}$$

$$V_{CE\text{-}low}=V_{CE\text{-}normal}-10\text{V.}$$

The effective pixel voltages $V_{Eink}$ (i.e., the voltage across the pixel capacitor $C_{DE}$, where $V_{Eink}=V_{CE}-V_{col}$) are now 0V, +10V or +20V for $V_{CE\text{-}high}$ of +10V, and −20V, −10V or 0V for $V_{CE\text{-}low}$ of −10V. The advantage is that there is always a 0V state available for the effective pixel voltage $V_{Eink}$. The disadvantage is that you have only 5 instead of 6 different effective levels for the effective pixel voltage $V_{Eink}$.

Thus, by addressing the common electrode 170 with a variable common electrode voltage $V_{CE}$, e.g., −10V, 0, +10V applied at an appropriate time relative the column voltage levels, e.g., −10V, 0, +10V, it is possible to increases the number of effective voltage levels available for the pixels, i.e., $V_{Eink}$, (e.g., $V_{Eink}$=−10V, 0, +10V when $V_{CE}$=0; $V_{Eink,}$=0V, +10V or +20V when $V_{CE}$=+10; and $V_{Eink,}$=−20V, −10V or 0V when $V_{CE}$=−10) The additional pixel voltage levels enable a better distribution and a higher accuracy of the grey levels of the display while using simple and cost effective column driver ICs. For example, 5 pixel voltage levels may be generated with 3-level column drivers when the common electrode 170 has the ability to be switched to 2 voltage levels, e.g., ±10V. Thus, a 1-output, 2-level common electrode driver 570 may be used along with a 3-level column driver 530 (having 320 outputs for example), instead of using a 5-level column driver with a 1-level common electrode driver. The controller 515 may be configured to control the various drivers 520, 530, 570 to provide the desired voltage levels, timing and switching of the various drivers 520, 530, 570, as described.

Of course, it is to be appreciated that any one of the above embodiments or processes may be combined with one or with one or more other embodiments or processes to provide even further improvements in finding and matching users with particular personalities, and providing relevant recommendations.

Finally, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the broader and intended spirit and scope of the present system as set forth in the claims that follow. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same or different item(s) or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise; and h) no specific sequence of acts or steps is intended to be required unless specifically indicated.

What is claimed is:

1. A display device comprising:

a row driver configured to provide a row voltage;

a row electrode connected to the row driver;

a column driver configured to provide at least three column voltage levels;

a column electrode connected to the column driver;

a common electrode driver configured to provide at least two common voltage levels;

a common electrode connected to the common driver;

a pixel connected between the column electrode and the common electrode; and a controller configured to control timing of application of the at least three column voltage levels relative the at least two common voltage levels to provide at least six effective pixel voltage levels across the pixel, wherein the controller is further configured to switch the common electrode at a same time and with a voltage swing corresponding to a storage voltage level of a storage capacitor which is connectable to the column electrode.

2. The display device of claim 1, wherein the at least two common voltage levels include a negative voltage level.

3. The display device of claim 1, wherein one of the at least three column voltage levels plus a kickback voltage is substantially equal to one of the at least two common voltage levels.

4. The display device of claim 1, wherein one non-zero level of the at least three column voltage levels plus a kickback voltage is substantially equal to one of the at least two common voltage levels.

5. The display device of claim 1, wherein the at least six effective pixel voltage levels include zero volts, a positive voltage level and a negative voltage level.

6. The display of claim 1, wherein the controller is further configured to switch the common electrode when (1) the row voltage has a non-select level, or (2) at the start of a row selection period or (3) during a row selection period.

7. The display of claim 1, wherein the common electrode and the storage capacitor are independently driven by a common electrode driver and by a storage driver, the common electrode driver and the storage driver being controlled by the controller.

8. The display of claim 1, wherein the common electrode and the storage capacitor are driven by a common electrode driver and by a storage driver, wherein the common electrode driver is controlled by the controller and the storage driver generates an output signal having a storage voltage level varying proportionally to the common voltage level generated by the common electrode driver.

9. A display device comprising:

a row driver configured to provide a row voltage;

a row electrode connected to the row driver;

a column driver configured to provide N column voltage levels;

a column electrode connected to the column driver;

a common electrode driver configured to provide M common voltage levels;

a common electrode connected to the common driver;

a pixel ($C_{DE}$) connected between the column electrode and the common electrode; and a controller configured to control timing of application of the N column voltage levels relative the M common voltage levels to provide NM effective pixel voltage levels across the pixel, wherein the controller is further configured to switch the common electrode at a same time and with a voltage swing corresponding to a storage voltage level of a storage capacitor connected to the column electrode.

10. The display device of claim 9, wherein the M common voltage levels include a negative voltage level.

11. The display device of claim 9, wherein one of the N column voltages levels plus a kickback voltage is substantially equal to one of the M common voltage levels.

12. The display device of claim 9, wherein one non-zero level of the N column voltages levels plus a kickback voltage is substantially equal to one of the M common voltage levels.

13. The display device of claim 9, wherein the NM effective pixel voltage levels include zero volts, a positive voltage level and a negative voltage level.

14. The display of claim 9, wherein the controller is further configured to switch the common electrode: (1) when the row voltage has a non-select level, (2) at the start of a row selection period or (3) during a row selection period.

15. The display of claim 9, wherein the common electrode and the storage capacitor are independently driven by a common electrode driver and by a storage driver, the common electrode driver and the storage driver being controlled by the controller.

16. The display of claim 9, wherein the common electrode and the storage capacitor are driven by a common electrode driver and by a storage driver, wherein the common electrode driver is controlled by the controller and the storage driver generates an output signal having a storage voltage level varying proportionally to the common voltage level generated by the common electrode driver.

17. A method of driving a display device having a row electrode, a column electrode, a common electrode and a pixel connected between the column electrode and the common electrode, comprising the acts of:

applying a row voltage to the row electrode;

applying a column voltage to the column electrode;

applying a common voltage to the common electrode;

varying the column voltage to provide N column voltage levels;

varying the common voltage to provide M common voltage levels;

controlling timing of application of the N column voltage levels relative the M common voltage levels to provide NM effective pixel voltage levels across the pixel ($C_{DE}$); and switching the common electrode at a same time and with a voltage swing corresponding to a storage voltage level of a storage capacitor which is connectable to the column electrode.

18. The method of claim 17, wherein the M common voltage levels include a negative voltage level.

19. The method of claim 17, wherein one of the N column voltages levels plus a kickback voltage is substantially equal to one of the M common voltage levels.

20. The method of claim 17, wherein the NM effective pixel voltage levels include zero volts, a positive voltage level and a negative voltage level.

21. The method of claim 17, further comprising the act of switching the common electrode: (1) when the row voltage has a non-select level, (2) at the start of a row selection period or (3) during a row selection period.

22. The method of claim 17, wherein a voltage proportional to the common voltage level is provided as the storage voltage.

23. The method of claim 17, wherein the storage voltage and the common voltage are provided by mutually independent drivers under common control.

* * * * *